US006219923B1

(12) United States Patent
Sinisi et al.

(10) Patent No.: US 6,219,923 B1
(45) Date of Patent: Apr. 24, 2001

(54) RETRACTABLE KNIFE

(76) Inventors: John Sinisi, 173 Moyer Rd., Chalfont, PA (US) 18914; Matthew A. Hanemann, 684 Joseph Ave., Warminster, PA (US) 18974; Joseph M. Vaccaro, 809 Independence Ave., Trenton, NJ (US) 08610

( * ) Notice: Subject to any disclaimer, the term of this patent is extended or adjusted under 35 U.S.C. 154(b) by 0 days.

(21) Appl. No.: 09/185,791

(22) Filed: Nov. 4, 1998

(51) Int. Cl.[7] ..... B26B 1/08
(52) U.S. Cl. ..... 30/162; 30/335
(58) Field of Search ..... 30/162, 335, 336; 606/167, 181

(56) References Cited

U.S. PATENT DOCUMENTS 1,448,305 * 3/1923 Langbein ..... 30/346
3,106,017 * 10/1963 Milbrandt ..... 30/162 X
3,885,308 * 5/1975 Gordin ..... 30/162
5,779,724 * 7/1998 Werner ..... 606/181 X
5,966,817 * 10/1999 Lee ..... 30/335 X

* cited by examiner

*Primary Examiner*—Douglas D. Watts
(74) *Attorney, Agent, or Firm*—Synnestvedt & Lechner LLP

(57) ABSTRACT

A retractable utility knife having a housing, a coil spring disposed within the housing, a blade, and a manually operable push button extending through the housing and in contact with the blade for movement therewith. The blade is positioned for longitudinal movement within a longitudinal passage defined within the coil spring. The spring biases the blade to the retracted position.

16 Claims, 5 Drawing Sheets

RETRACTABLE KNIFE

BACKGROUND OF THE INVENTION

The present invention relates to hand-held cutting knives, and more particularly to knives having retractable blades.

Hand-held utility knives such as those used by hobbyists, artists, draftsman, and those used for odd jobs around the home and office have long been known. A well-known form of such knife has a small metal blade detachably secured at one end of an elongate cylindrical handle and is ideal for detailed cutting work where tight control of the knife blade is required. Examples of such knives are sold under the X-Acto® trademark.

While known knives are excellent tools for detailed cutting, there is believed a need for a less expensive, more compact and disposable knife for the odd cutting job around the home or office. For some applications, the typical elongate handle can be a hindrance to the job at hand. Furthermore, the typical knife may not be practical for carrying and storage where a smaller sized knife would be preferable.

These and other limitations of known knives establish a need for a simple, compact, inexpensive and relatively safe utility knife.

SUMMARY OF THE INVENTION

One object of the present invention is to provide a utility knife having a blade that automatically retracts upon activation by the user. In this manner the blade defaults to a safe position and is extended only when desired by the user.

It is another object of the invention to provide a knife that has few parts, is simple to assemble, and is relatively inexpensive to produce. Reducing costs and minimizing the materials of production would make such knives more disposable, thereby avoiding the necessity of changing blades as required with known types of knives.

A further object of the invention is to provide a relatively small utility knife easily gripped with the fingertips for detailed cutting.

These objects are accomplished by providing a retractable knife having a housing which has a front and a rear and which forms an internal cavity. Disposed within the internal cavity is a coil spring which defines a longitudinal passage within the spring. The spring has first and second ends, the first end being substantially fixed relative to the housing between the front of the housing and the second end of the spring. Positioned for longitudinal movement within the longitudinal passage of the spring is the blade. Being retractable, the blade is movable between an extended position relative to the housing and a retracted position within the housing. The spring biases the blade towards the retracted position. A manually operable push rod extends through the housing and is in contact with the blade for movement therewith.

The knife can further include a release switch positioned on the housing to engage the push rod when the blade is in the extended position. The switch is moveable to a position disengaged from the push rod for releasing the blade. The switch preferably has an integral resilient shaft about which it can pivot to release the blade.

The knife may also include a safety switch positioned on the push rod to engage the housing when the blade is in the extended position. The safety switch is moveable to a position disengaged from the housing to release the push rod.

Additional objects, advantages and novel features of the invention will be set forth in part in the description which follows and in part will become apparent to those skilled in the art or may be learned by practice of the invention.

BRIEF DESCRIPTION OF THE DRAWINGS

The features, aspects and advantages of the present invention will become better understood with reference to the following description, claims and drawings where:

DETAILED DESCRIPTION

Figure 1:
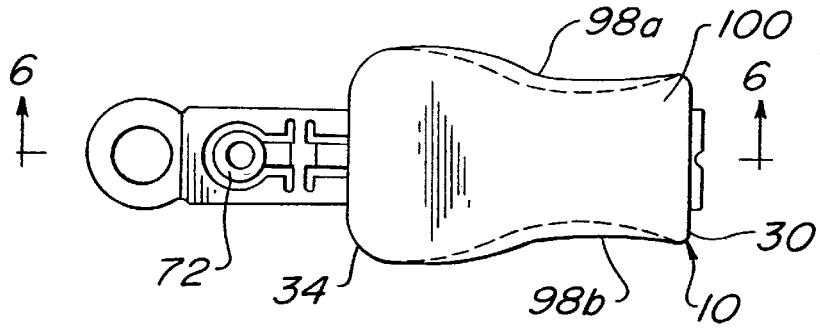
FIG. 1 is a top view of a knife of a preferred embodiment shown with the blade in the retracted position.
Figure 1A:
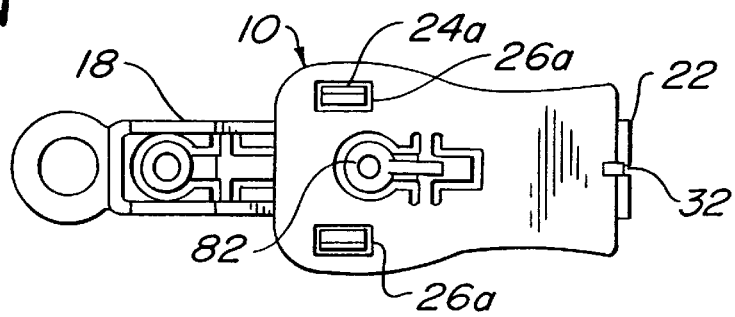
FIG. 1A is a bottom view of the knife of FIG. 1 shown with the blade in the retracted position.
Figure 1B:
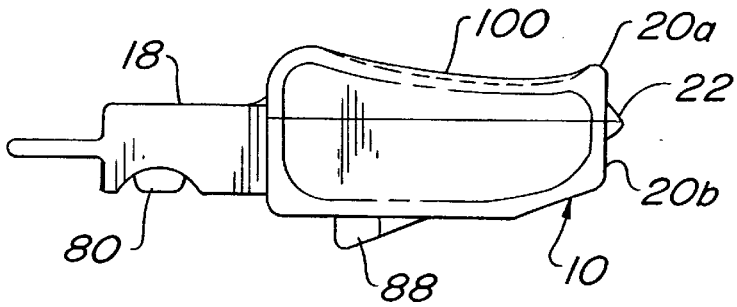
FIG. 1B is a side view of a knife of FIG. 1 shown with the blade in the retracted position.
Figure 2:
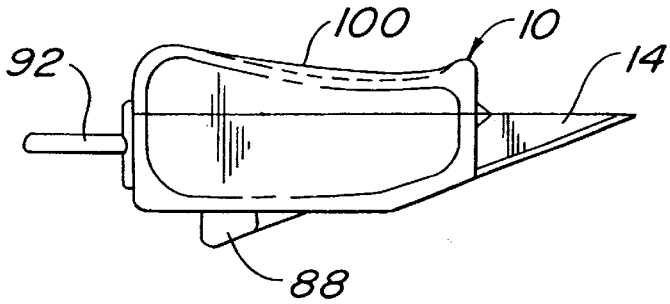
FIG. 2 is a side view of a knife of FIG. 1 shown with the blade in the extended position.

Illustrated in FIGS. 1 to 7 is a preferred embodiment of the present invention—a finger held knife 10 having a manually operable retractable blade 14 movable between a retracted position as shown in FIG. 1, and an extended position as shown in FIG. 2. As further explained below, the blade is biased towards the retracted position and is extended by manually moving the blade against the bias of a spring. This provides a safety feature in that the blade automatically defaults to the retracted position upon release and remains there unless manually moved to the extended position.

Figure 3:
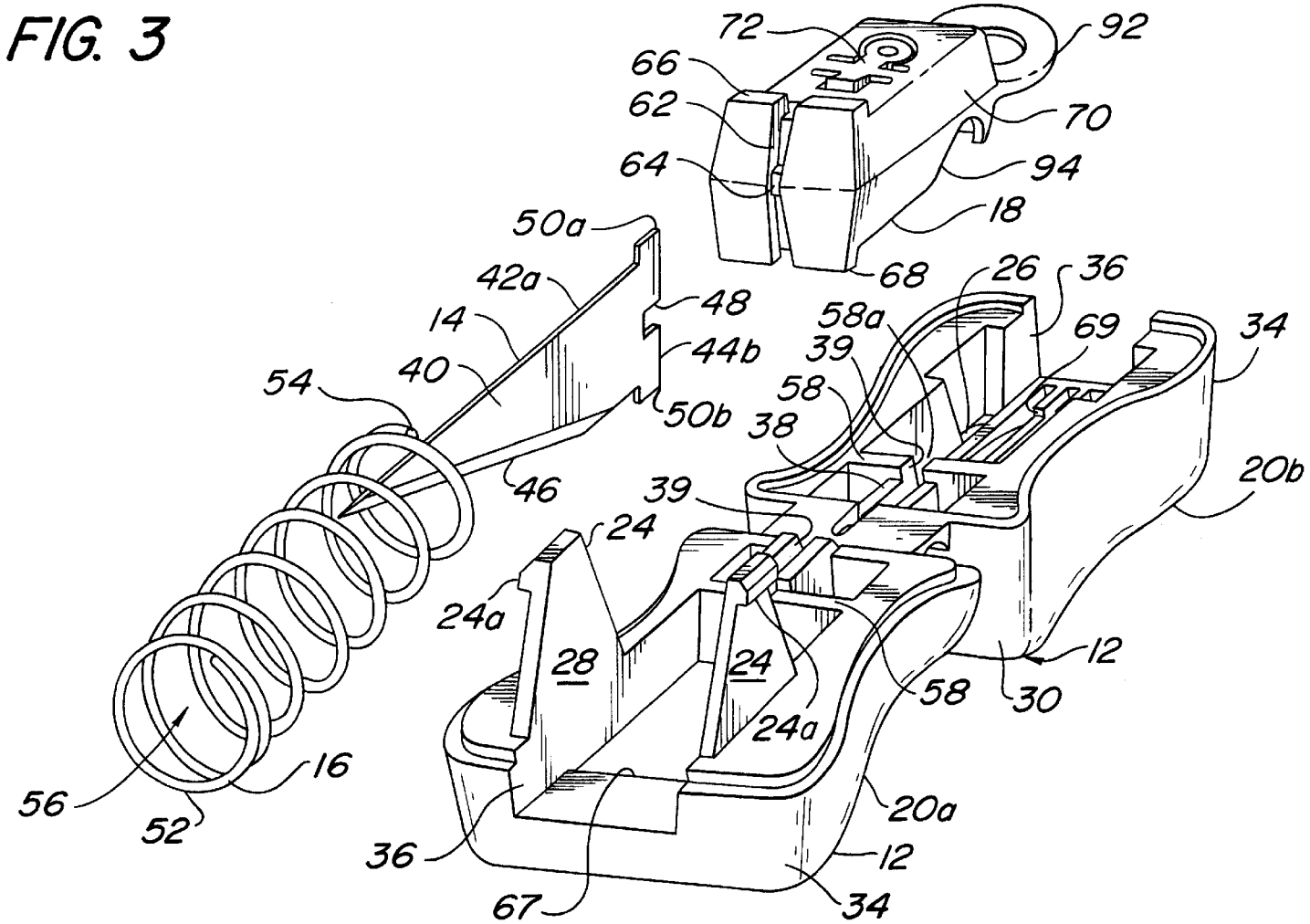
FIG. 3 is a perspective exploded view of the knife assembly of FIG. 1.
Figure 6:
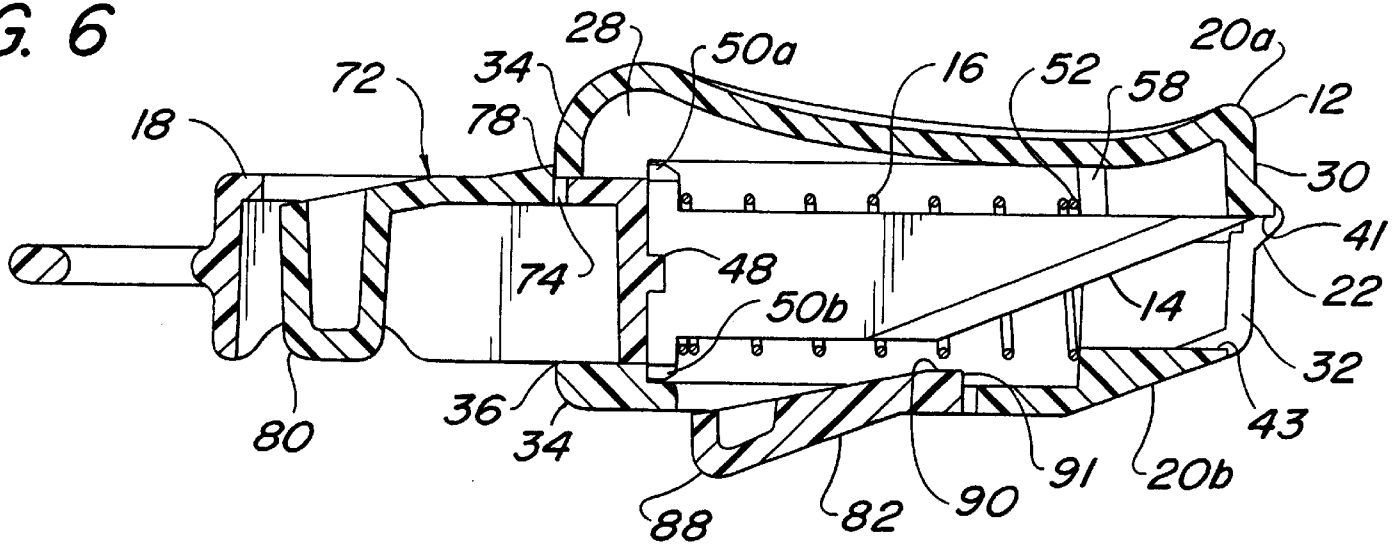
FIG. 6 is a cross sectional view taken along line 6—6 as shown in FIG. 1.
Figure 7:
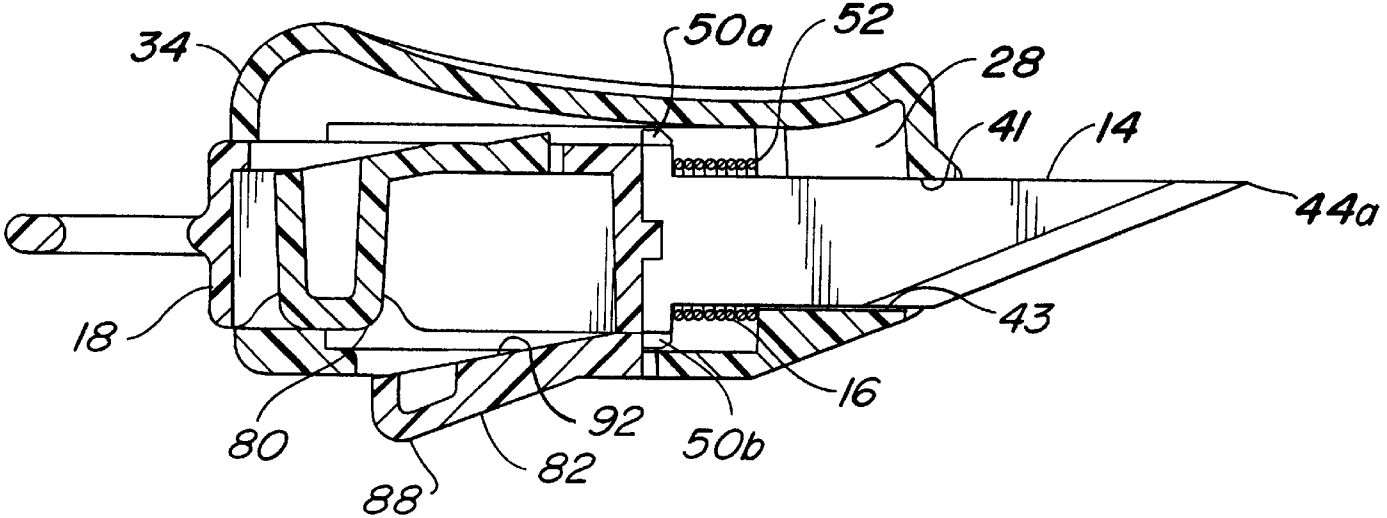
FIG. 7 is a cross sectional view similar to FIG. 6 showing the blade in the extended position.

With particular reference to FIGS. 3, 6 and 7, it is seen that the knife 10 includes a housing 12, the blade 14, a spring 16, and a push rod 18. The housing 12 is formed of two halves, a top-half 20*a* and a bottom-half 20*b* connected together by a hinge 22 of thin foldable material. The housing 12 is preferably formed of suitable plastic such as PET, ABS, and PVC which allows the two halves 20*a*, 20*b* to be molded as a unitary piece foldable about a living (foldable) hinge 22 for final assembly.

Resilient snap tabs 24 extending from the housing half 20*a* and having a lip 24*a* extend through corresponding receiving openings 26 in the housing half 20*b* where the lips 24*a* engage shoulders 26*a* on the outside of the housing 12 to hold the two halves together. Additional or alternative closure means such as adhesives may be used to fixedly secure the two halves together in the final closed position.

The housing 12 defines an internal cavity 28 configured to hold the blade 14, spring 16 and push rod 18. The front 30 of the housing 12 has a slotted opening 32 through which the blade 14 movably extends. The rear 34 of the housing 12 has a rectangular opening 36 through which the push rod 18 movably extends. Internal walls 38 form a slotted blade guide 39 in the front of the housing adjacent the slotted opening 32. A top edge 41 and lower edge 43 of the blade guide 39 limits the upward and downward movement of the blade. See FIGS. 6 and 7.

The blade 14 has an elongate body 40 formed of metal, upper and lower edges 42*a,* 42*b* respectively, and front and rear ends 44*a,* 44*b* respectively. Formed along the front end 44*a* is an angled knife edge 46. Formed at the rear 44*b* of the blade is a notch 48 and upper and lower tabs 50*a,* 50*b* which engage the spring 16 as further described below.

Referring to FIGS. 3 and 6, the spring 16 of the preferred embodiment is a helical coil spring having a first end 52, a second end 54, and which defines a longitudinal passage 56 within the coil between the first and second ends 52, 54. The spring 16 is positioned within the cavity 28 longitudinally between the front 30 and the rear 34 of the housing 12.

As best illustrated in FIGS. 3, 6 and 7, the blade 14 is positioned for longitudinal movement within the longitudinal passage 56 of the spring 16. The first end 52 of the spring is substantially fixed relative to the housing 12 by abutting an internal wall 58 of the housing(the wall 58 being formed of two half walls in each housing half 20*a,* 20*b*). A slot 58*a* through the wall 58 and opening to the guide slot formed by the internal wall 38 is provided through which the blade moves. The spring is "substantially fixed" in that the spring is not fixedly attached to the wall 58 and thus may have some play.

The second end 54 of the spring 16 engages and moves with the upper and lower tabs 50*a,* 50*b* of the blade 14 to bias the blade 14 towards the rear of the housing 12. Here, the spring's second end 54 simply abuts the tabs 50*a,* 50*b* without physical connection.

The push rod 18 extends through the opening 36 in the rear 34 of the housing 12 and is manually operable to move the blade 14 from the retracted position to the extended position. With reference to FIGS. 3, 4, 6 and 7, it is seen that the push rod 18 has a front end 60 having a channel 62 in which the rear end 44*b* of the blade 14 fits to prevent side-to-side movement of the rear end 44*b*. A key 64 within the channel 62 fits into the blade notch 48 to prevent vertical movement of the rear end 44*b*. It is seen that the spring 16 biases the push rod 18 towards the rear 34 of the housing 12. In the illustrated embodiment, this is done through the blade 14 which, biased rearward into contact with the push rod 18 by the spring, in turn biases the push rod rearward. Other possible configurations include a push rod fixedly connected to the blade 14 through means such as adhesives or molding the push rod onto the blade 14. In such configurations, the spring 14 could physically engage either the blade or push rod to engagingly bias the blade towards the retracted position.

The front end 60 of the push rod further has upper and lower catch tabs 66 and 68 respectively (FIGS. 3 and 4) extending beyond the main body 70 of the push rod. Both tabs 66, 68 abut respective ledges 67, 69 of the housing when the blade 14 is fully retracted to hold the push rod 18 within the housing 12. The lower catch tab 68 also holds the blade 14 in the extended position as further described below.

Figure 4:
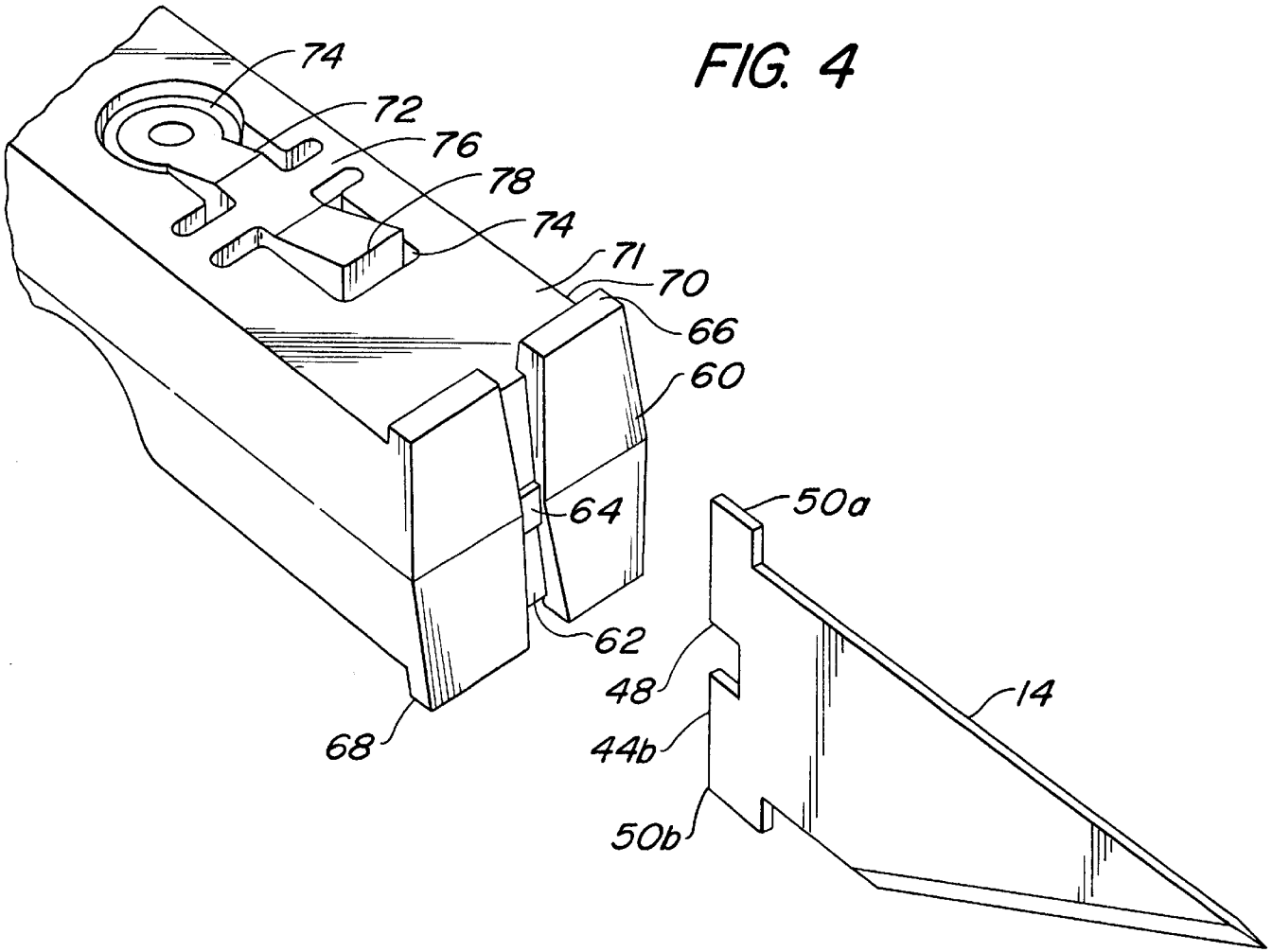
FIG. 4 is an enlarged view of the push rod and rear end of the blade.
Figure 5:
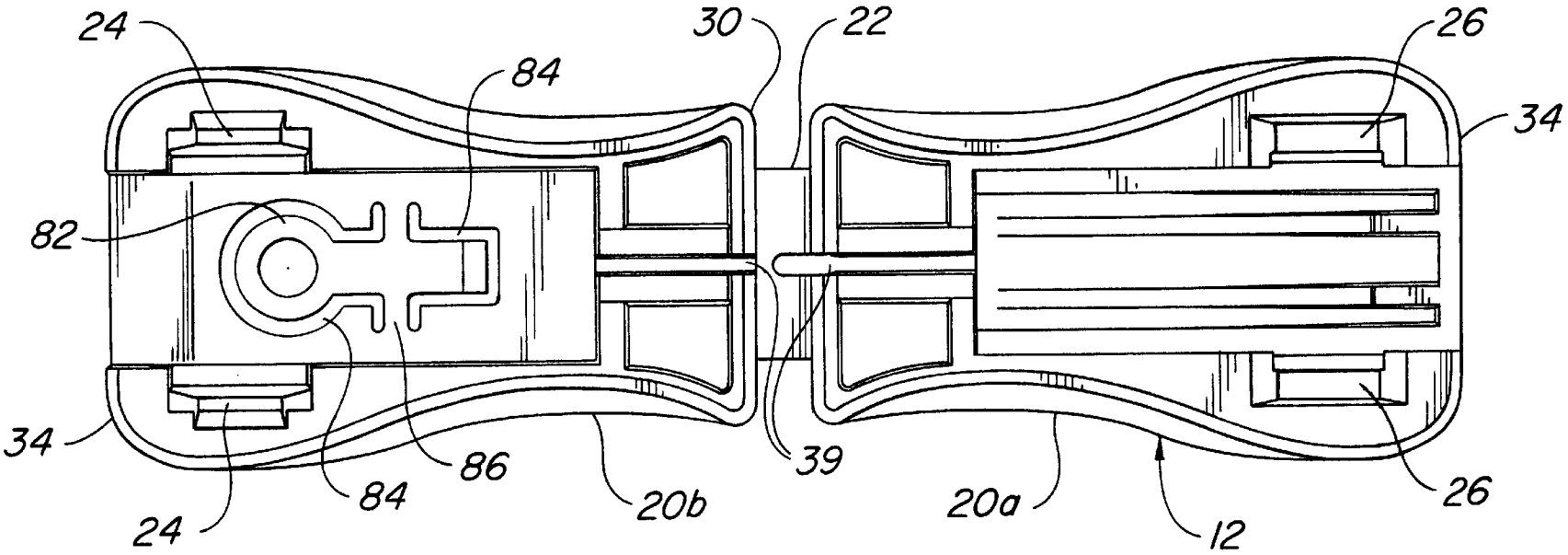
FIG. 5 is an elevational view of the housing showing the two halves in an unassembled form.

Formed on the top of the push rod 18 is a safety switch 72 which prevents accidental extension of the blade 14. With reference to FIGS. 3, 4 and 6, the illustrated switch 72 is integrally formed in the top surface of the push rod and is separate therefrom by a gap 74. The switch 72 is attached to the push rod via an integral shaft 76 about which the switch pivots. The shaft, being of the same material as the push rod, e.g. PTE, ABS, etc., is resilient and thus biased to return the switch 72 to its original position once moved. A raised catch 78 is formed on the front of the switch so as to extend vertically beyond the top 71 of the rush rod and engage the rear 34 of the housing 12 as shown to prevent forward movement of the push rod and the blade (see FIG. 6). A button 80 extends downward from the underside of the switch where it is manually operable to be pushed upward. Upward movement of the button 80 disengages the switch from the push rod by causing the catch 78 to pivot downward about the shaft 76 to release the push rod 18 for extending the blade.

Once the button 80 is manually operated to release the push rod 18, the blade 14 is extended by pushing the push rod forward against the bias of the spring 16. It is seen that the blade moves within the longitudinal passage 56 defined by the spring 16 as the blade front 44*a* exits through the slotted opening 32. The internal wall 58 and the length of the compressed spring 16 limits the forward movement of the blade.

With reference to FIGS. 1A, 5, 6 and 7, a release switch 82 locks the blade in the extended position, and, upon manual operation, releases the blade 14 for biased movement back to the retracted position. The release switch 82 is similar to the safety switch 72, being integrally formed as part of the bottom of the housing 12 and separated therefrom by a gap 84, and pivots about a resilient integral shaft 86 connecting the switch 82 to the housing 12. A button 88 extending from the bottom of the switch 82 allows convenient access for manual operation. At a forward section of the switch 82 is a catch 90 extending into the cavity 28 to engage the catch tab 68 of the push rod 18. As the push rod 18 moves forward to extend the blade 14, the catch tab 66 rides over the top surface 92 (within the cavity 28) of the switch 82, pushing the catch 90 downward about the shaft 86 against the natural bias of the shaft 86 until the catch tab 68 clears the switch at which point the catch 90 biasly snaps back into place behind the catch tab 68, thereby preventing retraction of the push rod and thus the blade. (Tab 68 is not shown in FIGS. 6 and 7 since the figures are cross sectional views. However, it is understood that the tab 68 engages the ledge 90 on both sides of the blade tab 50*b* which is shown in FIG. 6.) Manual operation of the button 88 upward rotates the catch 90 downward about the shaft 86 to releasably disengage the catch tab 66 and allow the spring 44 to retract the blade 14.

The push rod 18 of the present invention includes additional features such as a support ring 94 which can be used to support the knife 10, and contoured slots 96 providing convenient access to the button 80. Portions of the sides and top of the housing 12 are shaped ergonomically as shown to be comfortably grasped by the user.

The present invention provides a unique and novel compact knife that is inexpensive to make, disposable and easy to use. In operation, the knife 10 is moved into the blade extended position of FIG. 2 by simply pushing upward the button 80 of the push rod and then pushing the push rod forward until the blade is locked in its extended position by the release switch 82. For cutting, the knife 10 is preferably grasped on opposite sides 98*a,* 98*b* between the thumb and the middle finger, the index finger being placed on the top 100.

To release the blade to its retracted position, the button 88 is simply pushed to release the spring.

While the foregoing description is intended to describe a preferred embodiment of the present invention, it is not intended to limit it in any way. The invention is to be read as limited only by the scope of the appended claims.

What is claimed is:

1. A retractable knife comprising:

a housing having a front and a rear and forming an internal cavity;

a spring disposed within said cavity longitudinally between the front and rear of said housing, said spring defining a longitudinal passage therein, said spring having a first end and a second end;

a blade positioned for longitudinal movement within said passage, said blade having a knife edge facing the front of said housing, and a rear end facing said rear of said housing, said blade being moveable between an extended position relative to said housing and a retracted position within said housing, said blade being biased by said spring towards said retracted position;

a manually operable push rod extending through said housing, said blade movable to said extended position in response to movement of said push rod; and a release switch formed integrally on said housing and which has an integral shaft connecting said release switch to said housing, said release switch having a catch moveable relative to said housing and which is positioned to engage said push rod when said blade is in the extended position.

2. A knife in accordance with claim 1 wherein said push rod extends from the rear end of said housing and is disposed within said cavity to be in contact with said rear end of said blade for longitudinal movement therewith.

3. A knife in accordance with claim 2 wherein said push rod and said blade are independent members, said blade being biasly held in contact with said push rod by said second end of said spring.

4. A knife in accordance with claim 1 wherein said spring forms a cylindrical passage.

5. A knife in accordance with claim 1 wherein said rear end of said blade includes a tab, said second end of said spring being biased against said tab to urge said blade toward the rear of said housing.

6. A knife in accordance with claim 1 wherein said push rod includes a safety switch integrally formed thereon, said switch having an integral shaft connecting said switch to said push rod and a raised catch pivotal about said shaft and positioned to engage said housing when said blade is in the retracted position.

7. A knife in accordance with claim 1 wherein said shaft is resilient, and said catch comprises a raised ledge against which said push rod abuts when said blade is in the extended position.

8. A knife in accordance with claim 1 wherein said housing has first and second halves, said halves being connected to one another by an integral living hinge.

9. A knife in accordance with claim 8 wherein said first half includes a pair of resilient snap tabs having a lip, said second half includes a pair of receiving openings positioned to receive said snap tabs.

10. A retractable knife comprising:

a housing having a front and a rear and an internal cavity;

a coil spring disposed within said cavity longitudinally between the front and rear of said housing, said spring defining a longitudinal passage therein, said spring having a first end and a second end;

a blade positioned within said passage for longitudinal movement therein, said blade having a knife edge facing the front of said housing, and a rear end facing said rear of said housing, said blade being moveable between an extended position relative to said housing wherein said spring is compressed, and a retracted position within said housing, said spring positioned to urge said blade towards said retracted position;

a manually operable push rod in contact with said blade for movement therewith; and a release switch positioned on said housing to engage said push rod when said blade is in the extended position said switch being moveable to a position disengaged from said push rod to release said blade, said release switch is formed integrally on said housing and is connected thereto by an integral shaft about which said switch is pivotable.

11. A knife in accordance with claim 10 wherein said push rod and said blade are independent members, said blade being biasly held in contact with said push rod by said second end of said spring.

12. A knife in accordance with claim 10 further comprising a safety switch positioned on said push rod to engage said housing when said blade is in the retracted position, said safety switch being moveable to a position disengaged from said housing to release said push rod.

13. A knife in accordance with claim 12 wherein said safety switch is integrally formed on said push rod and is connected thereto by an integral shaft about which said switch is pivotable.

14. A retractable knife comprising:

a housing having a front and a rear and forming an internal cavity;

a spring disposed within said cavity;

a blade positioned for longitudinal movement within said cavity, said blade having a knife edge facing the front of said housing, and a rear end facing said rear of said housing, said blade being moveable between an extended position relative to said housing and a retracted position within said housing, said spring biasing said blade towards said retracted position;

a manually operable push rod extending through said housing, said blade movable to said extended position in response to movement of said push rod; and a release switch formed integrally on said housing, said release switch having a catch moveable relative to said housing between a first position for retaining said blade in the extended position and a second position for releasing said blade to said retracted position, said catch being biased towards said first position.

15. A retractable knife in accordance with claim 14 wherein said release switch has an integral shaft connecting said release switch to said housing, said catch being pivotable about said shaft.

16. A knife in accordance with claim 1 wherein said catch is pivotable about said shaft.

* * * * *